US009057341B2

(12) United States Patent
Strandburg, III et al.

(10) Patent No.: US 9,057,341 B2
(45) Date of Patent: Jun. 16, 2015

(54) ENGINE CYLINDER MID-STOP

(71) Applicant: CUMMINS IP, INC., Minneapolis, MN (US)

(72) Inventors: Alan Strandburg, III, Jamestown, NY (US); Kent H. Clark, Panama, NY (US)

(73) Assignee: CUMMINS IP, INC., Minneapolis, MN (US)

( * ) Notice: Subject to any disclaimer, the term of this patent is extended or adjusted under 35 U.S.C. 154(b) by 0 days.

(21) Appl. No.: 13/759,662

(22) Filed: Feb. 5, 2013

(65) Prior Publication Data

US 2014/0216388 A1 Aug. 7, 2014

(51) Int. Cl.

| | |
|---|---|
| ***F02F 1/00*** | (2006.01) |
| ***F02F 1/18*** | (2006.01) |
| *F02F 1/16* | (2006.01) |

(52) U.S. Cl.

CPC ..... *F02F 1/18* (2013.01); *Y10T 29/4927* (2015.01); *F02F 1/163* (2013.01); *F02F 1/004* (2013.01); *F02F 1/16* (2013.01)

(58) Field of Classification Search

CPC ..... F02F 1/16; F02F 1/163; F02F 1/004; F02F 11/005; F16J 10/04

USPC ..... 123/193.2

See application file for complete search history.

(56) References Cited

U.S. PATENT DOCUMENTS

| | | | | |
|---|---|---|---|---|
| 2,783,748 | A * | 3/1957 | Brenneke | 123/41.83 |
| 2,939,753 | A * | 6/1960 | Schilling et al. | 92/171.1 |
| 3,568,573 | A | 3/1971 | Bailey et al. | |
| 4,385,595 | A | 5/1983 | Shaw | |
| 4,523,555 | A * | 6/1985 | Mezger et al. | 123/193.3 |
| 4,562,799 | A * | 1/1986 | Woods et al. | 123/193.2 |
| 4,791,891 | A * | 12/1988 | Kubis et al. | 123/41.84 |
| 4,908,245 | A | 3/1990 | Shah et al. | |
| 5,193,577 | A | 3/1993 | de Koning | |
| 5,240,375 | A | 8/1993 | Wayte | |
| 5,251,579 | A * | 10/1993 | Morris | 123/41.84 |
| 5,575,251 | A | 11/1996 | Bock | |
| 5,967,109 | A * | 10/1999 | Bruce et al. | 123/193.2 |
| 6,367,848 | B1 | 4/2002 | Bruce et al. | |
| 6,532,915 | B2 | 3/2003 | Thompson | |
| 6,732,699 | B2 | 5/2004 | Wakade et al. | |
| 7,975,601 | B2 * | 7/2011 | Hittle et al. | 92/171.1 |
| 2006/0156917 | A1 * | 7/2006 | Oda et al. | 92/171.1 |

FOREIGN PATENT DOCUMENTS

| | | |
|---|---|---|
| GB | 2034419 A | 6/1980 |

OTHER PUBLICATIONS

International Search Report and Written Opinion for International Application No. PCT/US14/12173, dated Mar. 10, 2014, 13 pages.

* cited by examiner

*Primary Examiner* — Marguerite McMahon
*Assistant Examiner* — James Kim
(74) *Attorney, Agent, or Firm* — Foley & Lardner LLP

(57) ABSTRACT

According to one embodiment, an internal combustion engine includes a cylinder and liner. The cylinder includes a mid-stop formed in a side wall of the cylinder. The mid-stop includes a first contact surface and an undercut between the first contact surface and the side wall. The liner is positioned within the cylinder and includes a seat having a second contact surface. The second contact surface is supported on the first contact surface.

9 Claims, 7 Drawing Sheets

ENGINE CYLINDER MID-STOP

FIELD

This disclosure relates to internal combustion engines, and more particularly to cylinder mid-stops for supporting a cylinder liner.

BACKGROUND

The incorporation of replaceable cylinder liners in the design of an internal combustion engine provides numerous advantages to the manufacturer and user of such an engine. For example, replaceable liners can be easily removed and replaced during overhaul of the engine. Additionally, cylinder liners eliminate the necessity to scrap an entire engine block during manufacture should the inside surface of one cylinder be improperly machined. To assist in maintaining the liners in place within the cylinders during use, some conventional liner and cylinder configurations employ a stop (e.g., top-stop, mid-stop, bottom-stop) on which rests a seat formed in the liner.

Despite the above and other advantages, numerous problems attend the use of replaceable cylinder liners, as is exemplified by a large variety of cylinder and liner designs previously used by engine manufacturers. While each of the previously known liner designs may have demonstrable advantages, no single design appears to be optimal or void of problems and shortcomings.

For example, conventional engine systems with cylinder mid-stop and liner seat configurations suffer from several shortcomings. For example, significant cylinder and liner distortion can be experienced at the cylinder mid-stop and liner seat interface during operation of the engine.

The distortion of the cylinder and liner can induce relative motion between the cylinder and liner at the interface between the mid-stop and seat, which causes excess wear on the mid-stop and seat. The excess wear may negatively impact the performance of the engine, and in some instances, require replacement of the entire engine block. Some conventional engine systems position an annular shim between a top-stop and liner seat to reduce wear between the top-stop and seat. However, conventional engine systems with a mid-stop configuration have not employed an annular shim. Additionally, for those engine systems that do utilize shims between the liner and cylinder, the shims can be difficult to install and align with the liner during assembly. Such shims often are installed after original assembly of the engine, such as during a repair or reconditioning of the engine. For this reason, most shims are not well suited for installation during the original assembly of the engine.

Additionally, the distortion of the cylinder and liner may cause the liner to protrude into the cylinder cavity. Protrusion of the liner into the cylinder may cause the liner to impact the piston causing wear and deformation of the piston.

SUMMARY

The subject matter of the present application has been developed in response to the present state of the art, and in particular, in response to the problems and needs of conventional engine cylinders and liners that have not yet been fully solved by currently available engine configurations. For example, conventional engine systems may attempt to mask relative motion between the cylinder and liner seat by simply addressing the symptoms of such relative motion (e.g., wear) using shims that are difficult to install or shims positioned at a top-stop interface between the cylinder and liner seat. Moreover, none of the conventional engine systems attempt to address the root cause of the relative motion. In other words, some conventional engine systems are not configured to reduce wear between mid-stop and liner seat by preventing the relative motion therebetween. Essentially, some prior art engine systems accept relative motion between mid-stop and liner seat as inevitable, but fail to provide adequate measures to account for such relative motion. Most attempts at preventing the symptoms of relative motion (e.g., incorporating shims) add to the manufacturing complexity and cost of the engine system. Other prior art engine systems focus solely on preventing the symptoms of relative motion, rather than preventing the relative motion itself.

Accordingly, the subject matter of the present application has been developed to provide an engine cylinder that overcomes many of the shortcomings of the prior art. Generally, in some embodiments, a shim is positioned between the mid-stop and seat interface to reduce wear. In certain embodiments, the shim is desired to reduce manufacturing complexity and ensure proper alignment during assembly. According to other embodiments, the cylinder mid-stop is specifically designed to limit the relative motion between the mid-stop and liner seat. Accordingly, contrary to some prior art cylinder and liner assemblies, the subject matter of the present disclosure reduces wear between the mid-stop and liner seat by utilizing various shim design and placements, and addressing the root cause of relative motion. In this manner, relative wear and motion between the mid-stop and liner seat are reduced without unnecessarily increasing the manufacturing complexity and cost of the engine.

According to one embodiment, According to one embodiment, an internal combustion engine includes a cylinder and liner. The cylinder includes a mid-stop formed in a side wall of the cylinder. The mid-stop includes a first contact surface and an undercut between the first contact surface and the side wall. The liner is positioned within the cylinder and includes a seat having a second contact surface. The second contact surface is supported on the first contact surface.

In some implementations of the engine, the cylinder defines a central axis and the first contact surface is substantially perpendicular to the central axis. The undercut can extend downwardly away from the first contact surface. In certain implementations, the mid-stop includes a mid-stop region that defines the first contact surface and the undercut defines a space between the mid-stop region and the side wall. The mid-stop region can be deformable in a radially outward direction toward the side wall when subjected to operational loads.

According to certain implementations of the engine, the undercut includes an annular groove. The undercut can be positioned radially inward from the side wall. When subjected to operational loads, the first contact surface and the second contact surface can move in a radially outward direction toward the sidewall. The undercut can facilitate co-motion of the first and second contact surface when subjected to operational loads.

In another embodiment, a cylinder for an internal combustion engine includes a channel that extends from a top end to a bottom end. The channel is defined by a sidewall. The cylinder also includes an annular mid-stop region that extends about a circumference of the channel. Further, the cylinder includes an annular undercut that extends about the circumference of the channel between the annular mid-stop region and the sidewall.

According to some implementations of the cylinder, the annular mid-stop region defines a contact surface that extends substantially perpendicularly relative to a central axis of the channel. The annular undercut can define a space between the mid-stop region and the sidewall. The annular mid-stop region may be configured to deform and move in a radially outward direction toward the sidewall into the space under operation loads.

In certain implementations of the cylinder, the annular undercut includes an annular groove that vertically penetrates the mid-stop region. The annular undercut can include a concave surface. In some implementations, a ratio of a first width of the annular mid-stop region and a second width of the annular undercut is between about 0.20 and about 0.5. A depth of the annular undercut can be more than about 2% of a height of the channel above the annular undercut. In some implementations, the annular undercut has a substantially semi-circular shaped surface.

In yet another embodiment, a method for reducing wear in an internal combustion engine that has a cylinder and a cylinder liner supported within the cylinder is disclosed. The method includes providing a mid-stop within the cylinder where the mid-stop includes a mid-stop region and an undercut positioned between the mid-stop region and a sidewall of the cylinder. Also, the method includes providing a seat on the cylinder liner and positioning the seat on the mid-stop region. The method further includes moving both the mid-stop region and seat in a radially outward direction toward the sidewall of the cylinder.

According to some implementations, the method also includes applying compressive and lateral loads to the mid-stop region and seat. Moving both the mid-stop region and seat in a radially outward direction toward the sidewall of the cylinder can occur during the application of the compressive and lateral loads. Additionally, the method can include releasing the compressive and lateral loads from the mid-stop region and seat. Further, the method may include moving both the mid-stop region and seat in a radially inward direction away from the sidewall of the cylinder during the release of the compressive and lateral loads.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
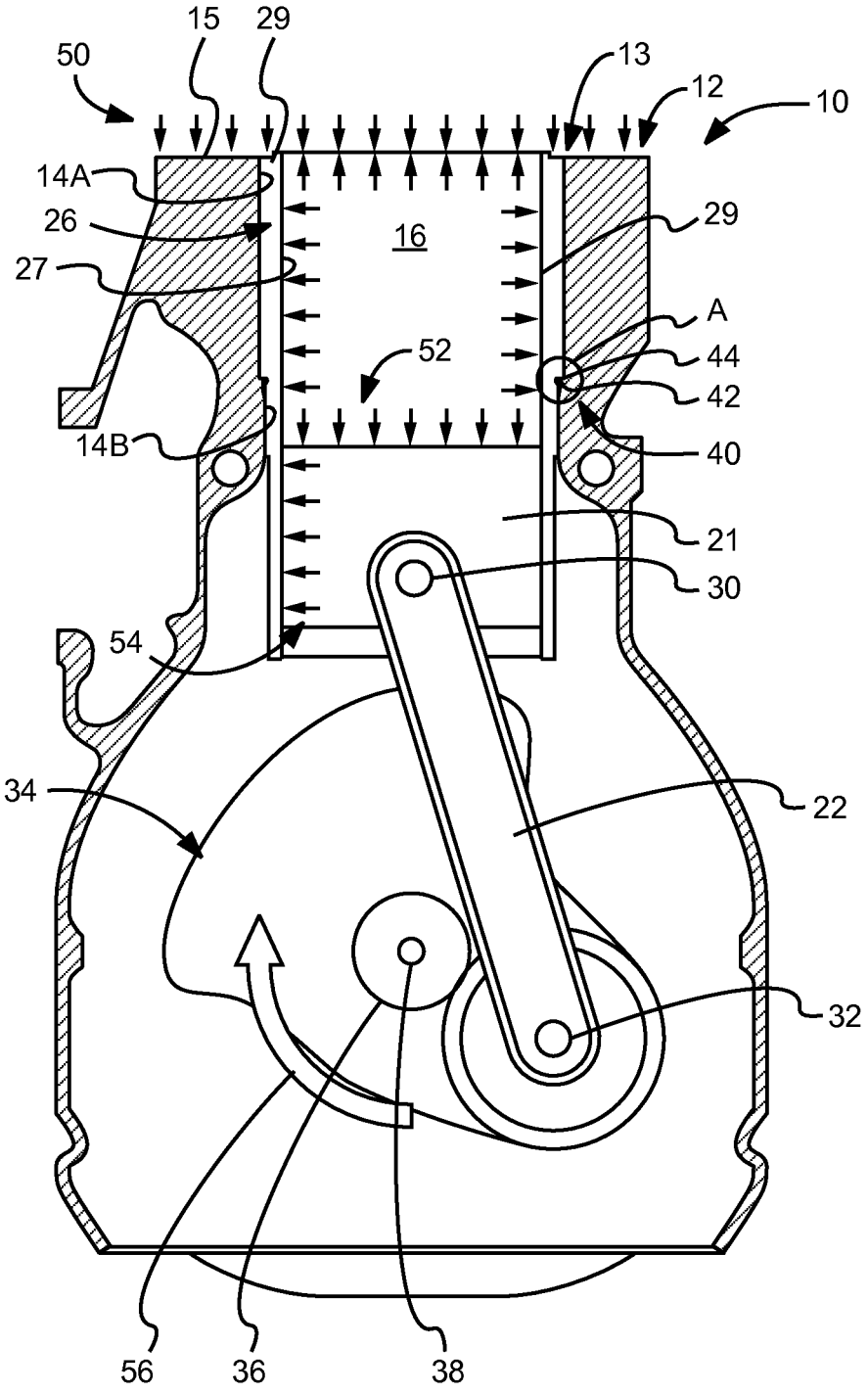
FIG. 1 is a cross-sectional side view of an engine system with a cylinder and cylinder liner according to one embodiment.

Referring to FIG. 1, according to one embodiment, an engine 10 includes an engine block 12 with a cylinder 13. The cylinder 13 is formed into the engine block 12 and includes a radially inner wall or surface that defines a liner receiving space. As defined herein, the radial direction or radially directed is associated with a direction that is perpendicular to a central axis 95 of the cylinder 13, which is coaxial with the piston 21. Further, the cylinder 13 includes a mid-stop or shelf 42 formed in the inner wall. The mid-stop 42 extends circumferentially about the cylinder 13 and separates the cylinder into an upper section above the mid-stop and a lower section below the mid-stop. The mid-stop 42 also separates the inner wall into an upper inner wall 14A and lower inner wall 14B. The upper section has a diameter greater than the lower section. Additionally, the mid-stop 42 is defined as a mid-stop because it is positioned within the cylinder 13 away from a top 15 (e.g., upper opening) of the cylinder 13. The mid-stop 42 forms part of a mid-stop and liner interface 40, which is defined as the physical interface between the mid-stop 42 and a seat 44 of a cylinder liner 26.

Figure 2:
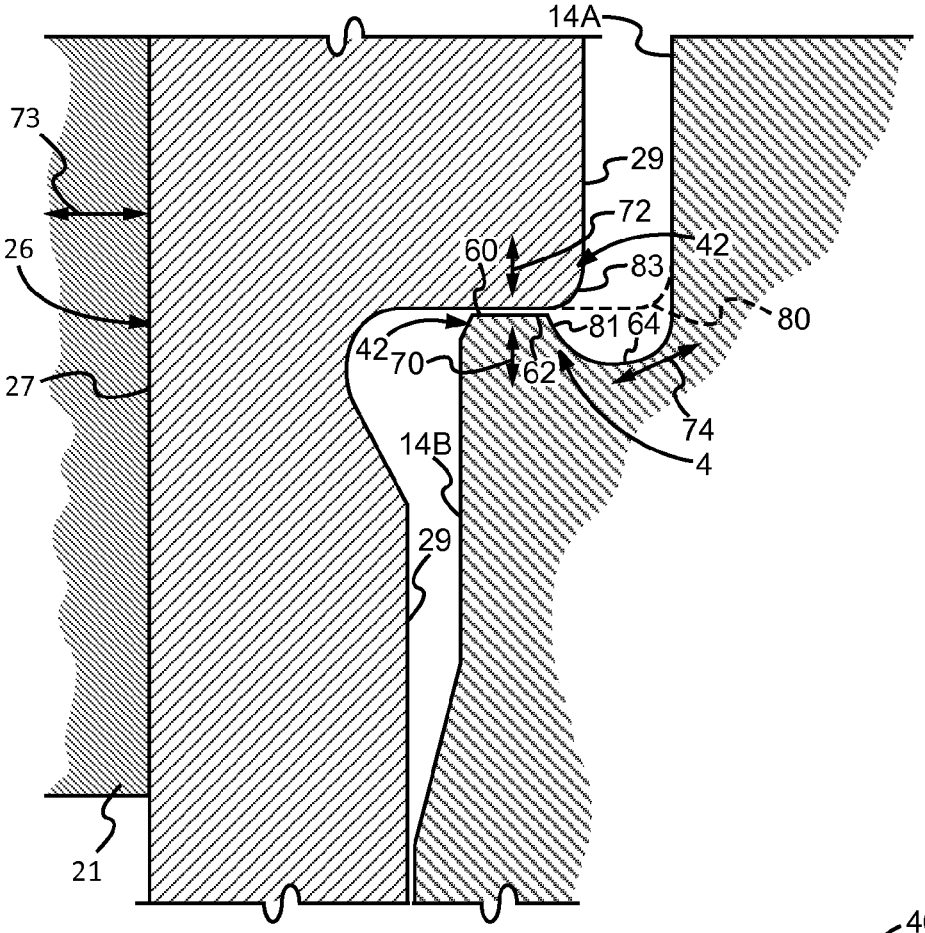
FIG. 2 is a detailed cross-sectional side view of a mid-stop and seat interface according to the detail A in FIG. 1.

The cylinder liner 26 is sized and shaped to nestably mate with the cylinder 13. Accordingly, the cylinder liner 26 includes a generally cylindrically shaped tube with a radially outer wall or surface 29 that substantially matches the radially inner walls 14A, 14B of the cylinder 13. Additionally, the seat 44 of the liner 26 extends circumferentially about the liner. The seat 44 rests on and is supported by the mid-stop 42. Accordingly, the mid-stop 42 and seat 44 each includes mating surfaces. For example, as shown in FIG. 2, the mid-stop 42 includes a first contact surface 60 and the seat 44 includes a second contact surface 62. The region within which the first contact surface 60 is in contact with the second contact surface 62 can be defined as a contact region. The contact region illustrated in FIG. 2 shows a gap between the contact surfaces 60, 62 for convenience in illustrating the details of the present subject matter. In practice, the contact surfaces 60, 62 will be in contact with each other during operation of the engine 10.

Each of the first and second contact surfaces 60, 62 is substantially flat and defines a plane that is substantially perpendicular to the central axis 95 of the cylinder 13. Therefore, the first contact surface 60 extends substantially perpendicularly relative to the inner walls 14A, 14B of the cylinder 13 at least proximate the contact region. Likewise, the second contact surface 62 extends substantially perpendicularly relative to the inner wall 27, and the outer wall 29 in some locations, of the liner 26. The portion of the cylinder 13 defining the first contact surface 60 is defined herein as a mid-stop region 81, and the portion of the liner 26 defining the second contact surface 62 is defined herein as a seat region 83. The mid-stop region 81 includes the portion of the cylinder 13 directly adjacent (e.g., below) the first contact surface 60 in the radially outward direction, but the mid-stop region (and first contact surface) is spaced radially inwardly from the upper inner wall 14A of the cylinder 13 by virtue of an undercut 64 as will be explained in more detail below. In fact, a radially outward portion of the mid-stop region 81 is defined by the undercut 64. The seat region 83 includes the portion of the liner 26 directly adjacent the second contact surface 62 in the radially outward direction. As used herein, radially inward and outward is made with reference to the central axis 95 of the cylinder 13.

With the seat 44 supported on the mid-stop 42, a top end 29 of cylinder liner 26 extends upwardly just beyond the top 15 of the cylinder 13. Although not shown, a head gasket and cylinder head are mounted to the engine block 12 atop the cylinder via a plurality of fasteners during assembly of the engine 10. As the cylinder head is tightened against the engine block 12, the cylinder head contacts and applies a compressive load 50 against the cylinder liner 26. The compressive load 50 on the cylinder liner 26 is transferred to a corresponding tensile load applied to the mid-stop 42 via engagement between the mid-stop and seat 28. Accordingly, the seat 44 is pre-loaded in compression against the mid-stop 42, and the mid-stop 42 is pre-loaded in tension, via the compressive load 50 applied to the liner 26 via the cylinder head.

The radially inner wall or surface 27 of the cylinder liner 26 defines a channel 16 along which a piston 21 linearly travels during operation of the engine 10. The portion of the channel 16 of the cylinder liner 26 above the piston 21 can be defined as the combustion chamber of the cylinder 13. The channel 16 is cylindrical and sized to substantially match (e.g., be slightly less than an interference fit with) the exterior surface of the piston 21. Fuel and air are combusted within the combustion chamber, with the combustion energy or forces 52 radiating outwardly against the walls defining the combustion chamber. A portion of the combustion energy 52 applies lateral loads or forces against the liner 26. Another portion of the combustion energy 52 applies downwardly directed loads against the piston 21, which drives downward movement of the piston 21 within the channel 16.

As the piston 21 is downwardly driven, the piston rotates a crankshaft 36 as indicated by directional arrow 56 via a connecting rod 32. The connecting rod 32 is rotatably coupled to the piston 21 at a first end 30 and rotatably coupled to a counterweight 34 of the crankshaft 36 at a second end 32 opposite the first end. The rotational energy or momentum of the crankshaft 36 facilitated by the counterweights 34 upwardly drives the piston 21 along the channel 16. As the piston 21 transitions from travel in an upward direction back to a downward direction after reaching a top-dead-center (TDC) position (e.g., at the top of the piston stroke), the initial angling of the connecting rod 22 drives the piston into a thrust side of the liner 26. The side loading of the piston 21 in this manner imparts a lateral or side force 54 against the inner wall 27 of the liner 26 and thus the inner walls 14A, 14B of the cylinder 13.

Figure 3:
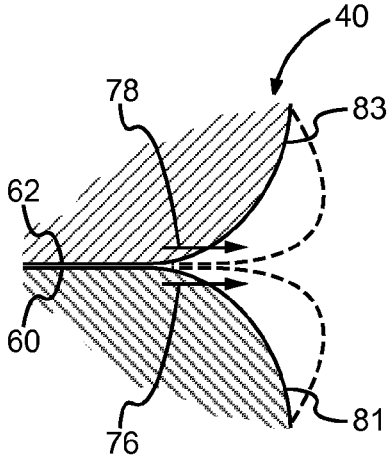
FIG. 3 is a cross-sectional side view of a mid-stop and seat interface under compressive and lateral loads according to one embodiment.

Based on the foregoing, during operation of the engine 10, axial (e.g., compressive or tensile) loads are being applied against the interface 44 of mid-stop 42 and seat 44, as well as lateral (e.g., side or shear) loads. The varying axial and lateral loads can be defined as operation loads. Additionally, thermal loads affect the axial and lateral loads on the interface 44. Each of the axial and lateral loads acting on the interface 44 affects the deformation and relative movement of the mid-stop 42 and seat 44 differently. For example, as shown in FIG. 3 in dashed lines, because there are no radially outward constraints on the seat region 83, the compressive load 72 acting on the liner 26 causes the seat region 83 of the liner to deform, squish, or bulge radially outwardly away from the central axis 95 of the cylinder. This radially outward deformation of the seat region 83 also results in micro-motion of the contact surface 62 in a radially outward direction 78. The lateral load 73 acting on the liner 26 by virtue of the piston 21 tends to deflect the liner radially outwardly, which contributes to the radially outward deformation of the seat region 83 and micro-motion of the contact surface 62 in the radially outward direction 78.

The compressive load 70 acting on the mid-stop 42 at the first contact surface 60 may also cause deformation and relative movement of the mid-stop region 81. In addition to the load from the assembly of the cylinder head, the compressive load 70 may also include a compressive load induced by the outward deflection of the liner 26 due to the lateral load 73. Because the liner 26 is axially constrained above by the cylinder head and below by the mid-stop 42, the outward deflection induces a compressive load onto the mid-stop. Prior art cylinder configurations included a mid-stop 80 (see FIG. 2) with a contact surface directly coupled to the radially inner wall of the cylinder. Because the contact surface is directly coupled to the inner wall, the inner wall of the cylinder, the wall provides a radially outward constraint preventing deformation in the radially outward direction. Accordingly, when applied onto the contact surface of the conventional mid-stop 80, the compressive load 70 induced a tensile load 74 in the mid-stop proximate the inner wall of the cylinder that was directed away from the inner wall. The tensile load caused the conventional mid-stop 80 to deform axially downwardly away from the liner seat, and also caused micro-movement of the mid-stop radially inwardly away from the inner wall.

Accordingly, for prior art mid-stops 80, the compressive loads 70, 72, side load 73, and tensile load 74 resulted in relative micro-motion of the first contact surface of the mid-stop 80 and the second contact surface of the seat. More specifically, the applied loads onto conventional mid-stop and seat interfaces caused the mid-stop contact surface to move radially inwardly and the seat contact surface to move radially outwardly. The relative motion of the contact surfaces promoted significant wear of the cylinder mid-stop and liner seat.

Additionally, while some of the applied loads are relatively constant, such as the compressive load generated by the mounting of the cylinder head to the engine block 12, other loads are dynamic with magnitudes that can vary or alternate during operation of the engine. For example, as the piston cycles through various positions within the channel 16 during the combustion cycles of the engine, the compressive and lateral loads on the interface 44 also cycle between varying magnitudes. Also, the compressive and lateral loads may fluctuate as the thermal loads within the system change during operation. For conventional systems, such alternating loads caused repetitive movement of the contact surfaces of the cylinder mid-stop and liner seat, which intensified the relative wear of the mid-stop and liner seat. As long as the contact surfaces of the mid-stop and liner seat experience relative motion, significant wear of the mid-stop and liner seat will occur.

To reduce, and in some cases prevent, relative motion between the contact surfaces 60, 62 of the mid-stop 42 and seat 44, respectively, and thus reduce wear of the mid-stop and seat during operation of the engine 10, the mid-stop includes an undercut 64. The undercut 64 is positioned between the contact surface 60 of the mid-stop 42 and the upper inner wall 14A of the cylinder 13. As shown in FIG. 2 with reference to the prior mid-stop design 80 without an undercut, the undercut 64 extends axially downwardly relative to the central axis 95 of the cylinder 13 and the contact surface 60. Accordingly, the undercut 64 extends below the contact surface 60, which allows a portion of the mid-stop region 81 to be open to the space defined by the undercut, and to face the upper inner wall 14A.

The application of compressive and lateral loads results in deformation and movement of the mid-stop 42 that is different than prior art mid-stops. For example, because the undercut 64 is open or faces the inner wall 14A, the inner wall does not radially outwardly constraint the mid-stop region 81 in the same manner as with prior art mid-stops 80. Accordingly, without the radially outward constraint of the wall, the compressive load 70 applied to the mid-stop 42 results in the mid-stop region 81 of the cylinder 13 deforming, squishing, or bulging radially outwardly away from the central axis 95 of the cylinder in substantially the same manner as the seat region 83 (see, e.g., FIG. 3 as shown in dashed lines). Further, the radially outward deformation of the mid-stop region 81 also results in micro-motion of the contact surface 60 in a radially outward direction 76. The radially outward direction 76 of the movement of the mid-stop region 81 is the same as the radially outward direction 78 of the movement of the seat region 81. In other words, the mid-stop and seat regions 81, 83 move in the same direction under the same loads. Moreover, the configuration (e.g., size and shape) of the undercut 64 and mid-stop region 81 is selected such that the rate of movement is approximately the same. Because the direction and rate of motion of the mid-stop and seat regions 81, 83 are substantially the same, the mid-stop and seat regions do not experience substantial relative motion. Consequently, without substantial relative motion, wear of the mid-stop region 81 by the seat region 83, and wear of the seat region by the mid-stop region, is significantly reduced, and eliminated in some applications. Based on the foregoing, the introduction of the undercut 64 does not prevent micro-movement of the mid-stop region 81 and seat region 83, but the undercut does reduce and even prevent relative movement between the mid-stop region and seat region.

The alternating loads experienced during operation of the engine 10 do not affect the benefit of restricting relative motion between the mid-stop and seat regions 81, 83 through use of the undercut 64. As has been described above, as certain compressive and lateral loads are applied to the mid-stop and seat regions 81, 83, the regions correspondingly bulge and move radially outwardly. As the compressive and lateral loads are released, the mid-stop and seat regions 81, 83 retract from the deformed state back to a non-deformed state in approximately the same direction and at approximately the same rate. Accordingly, the mid-stop and seat regions 81, 83 not only do not experience motion relative to each other during the application of loads, but the regions also do not experience motion relative to each other during the release of the loads. In this manner, relative motion and wear of the mid-stop and seat are reduced even during reciprocating and alternating loads.

Figure 4:
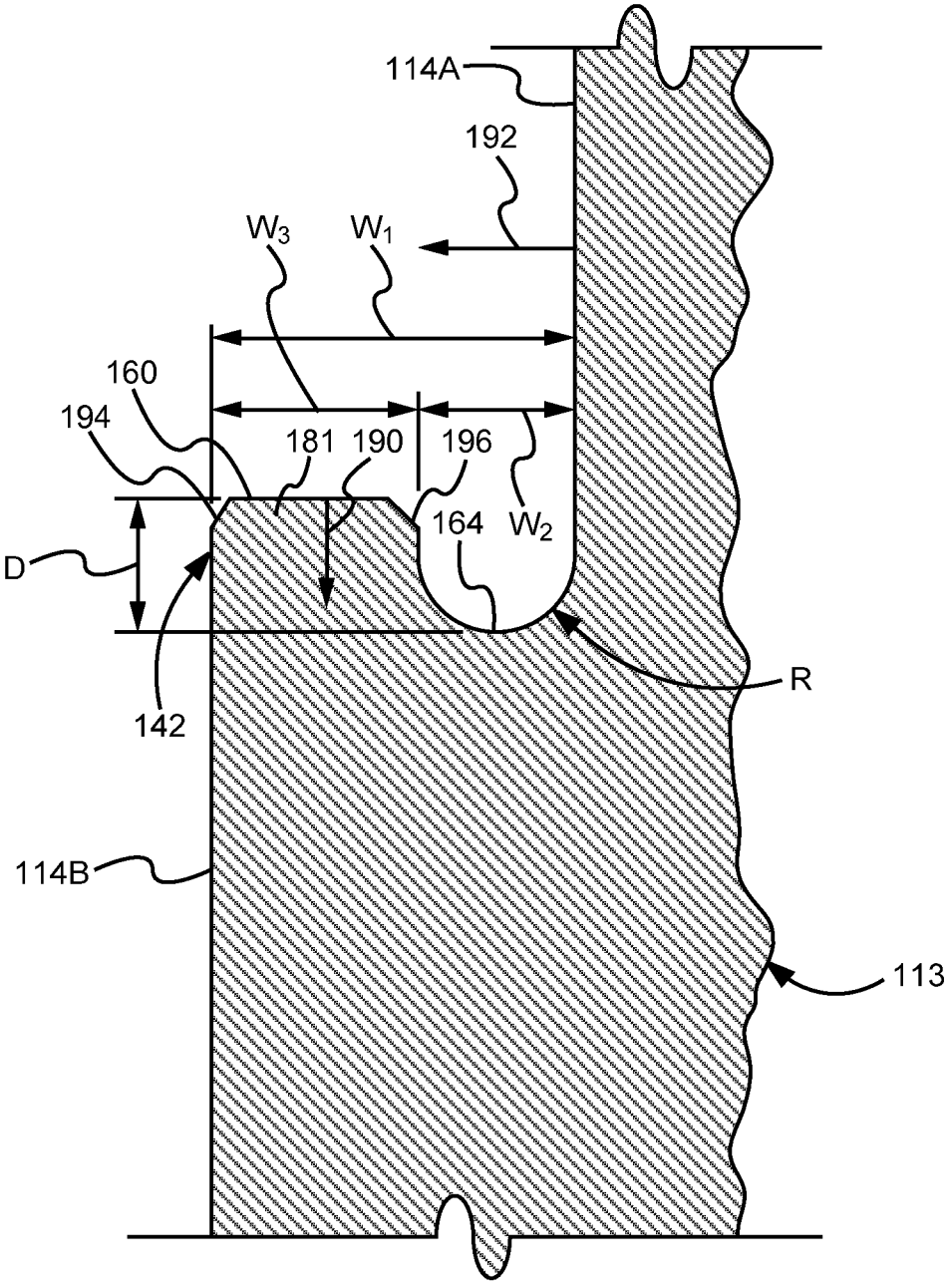
FIG. 4 is a cross-sectional side view of a mid-stop of a cylinder according to one embodiment.

Referring to FIG. 4, an embodiment of a cylinder 113 with a mid-stop 142. The cylinder 113 is similar to the cylinder 13 of FIG. 3, with like numbers referring to like elements. For example, the mid-stop 142 extends circumferentially about the cylinder 113. The mid-stop 142 also includes a first contact surface 160 and a mid-stop region 181 defining the first contact surface. Like the first contact surface 60, the first contact surface 160 is substantially flat and defines a plane that is substantially perpendicular to the central axis of the cylinder and an upper inner wall 114A of the cylinder as indicated by directional arrow 192. The first contact surface 160 is spaced radially inwardly from the upper inner wall 114A of the cylinder 113 by the undercut 164. In other words, the undercut 164 is positioned between the upper inner wall 114A and the first contact surface 160.

Like the undercut 64, the undercut 164 extends axially downwardly relative to the central axis of the cylinder 13 and the first contact surface 60 as indicated by the directional arrow 190, which is parallel to the central axis. Therefore, the surface of the undercut 164 is positioned below the first contact surface 60, and thus does not contact or support a second contact surface of a liner seat. In this manner, the undercut 164, like the undercut 64, can be defined as a vertical undercut. The depth D of the undercut 164, or the distance in the direction 190 from the first contact surface 60 to a lowermost point of the undercut, can vary as desired. The depth D is selected to provide a sufficient portion of the mid-stop region 181 to be open to the space defined by the undercut 164 to induce radially outward directed deformation of the mid-stop region as discussed above. In some implementations, the depth D of the undercut 164 is greater than about 2% of the height of the upper wall 114A (e.g., the distance from a top of the cylinder 113 to the first contact surface 160). The depth D is essentially equal to the height of the mid-stop region 181.

The width $W_2$ of the undercut 164, or the distance in the direction 192 from the inner wall 114A to the first contact surface 160 also can vary as desired. The width $W_2$ is selected to provide a sufficient distance between the mid-stop region 181 and the upper inner wall 114A such that the radially outward constraint of the inner wall does not constrain the radially outward movement and bulging of the mid-stop region. In some implementations, the width $W_2$ is about equal to the depth D. In certain implementations, as examples only, the width $W_2$ is more than about 20% of the width $W_3$ of the mid-stop region 181, and can be between 20% and about 50% of the width $W_3$ in some implementations. According to certain implementations, as examples only, the width $W_2$ is more than about 20% of the total width $W_1$ of the mid-stop 142, and can be between 20% and about 40% of the width $W_1$ in some implementations. Accordingly, the width $W_2$ of the undercut 164 can be more than about 20% of the total width $W_1$ of the mid-stop 142 in certain implementations, and can be between 20% and 40% of the total width $W_1$ in some implementations.

In one specific implementation, as an example only, the $W_1$ is between about 4 and about 6 mm. In yet one specific implementation, as an example only, the $W_2$ is between about 1 and about 2 mm. According to one specific implementation, as an example only, the depth D is between about 1 and about 2 mm. As an example, the depth D can be between about 20% and about 70% of the width $W_3$ of the mid-stop region 181 is some specific implementations.

The undercut 164 defines an annular groove that extends circumferentially around the cylinder 113. The groove is concentric with the annular first contact surface 160 of the mid-stop region 181. As shown, the annular groove of the undercut 164 can be formed with a radiused (e.g., semi-circular shaped) surface with a radius R. The radius R can be any of various radiuses as desired. In one implementation, the radius R is between about 50% and about 100% of the depth D. Although the illustrated undercut 164 has a concave and relatively uniformly curved surface, in other embodiments the undercut can be linear or non-uniformly curved surfaces. Similarly, the mid-stop region 181 may include radiused inner and outer edges 194, 196 adjacent the first contact surface 160.

The cylinder and cylinder liner, including the mid-stop and seat, can be made of any of various materials and formed using any of various manufacturing techniques. For example, in one implementation, the cylinder and cylinder liner each is made from iron and the formed using a casting technique. In other implementations, the cylinder and liner can be made from aluminum and formed using a machining technique. In yet some implementations, the cylinder and liner are made from a combination of materials, or can be formed using a combination of manufacturing techniques, such as casting and machining.

Figure 5:
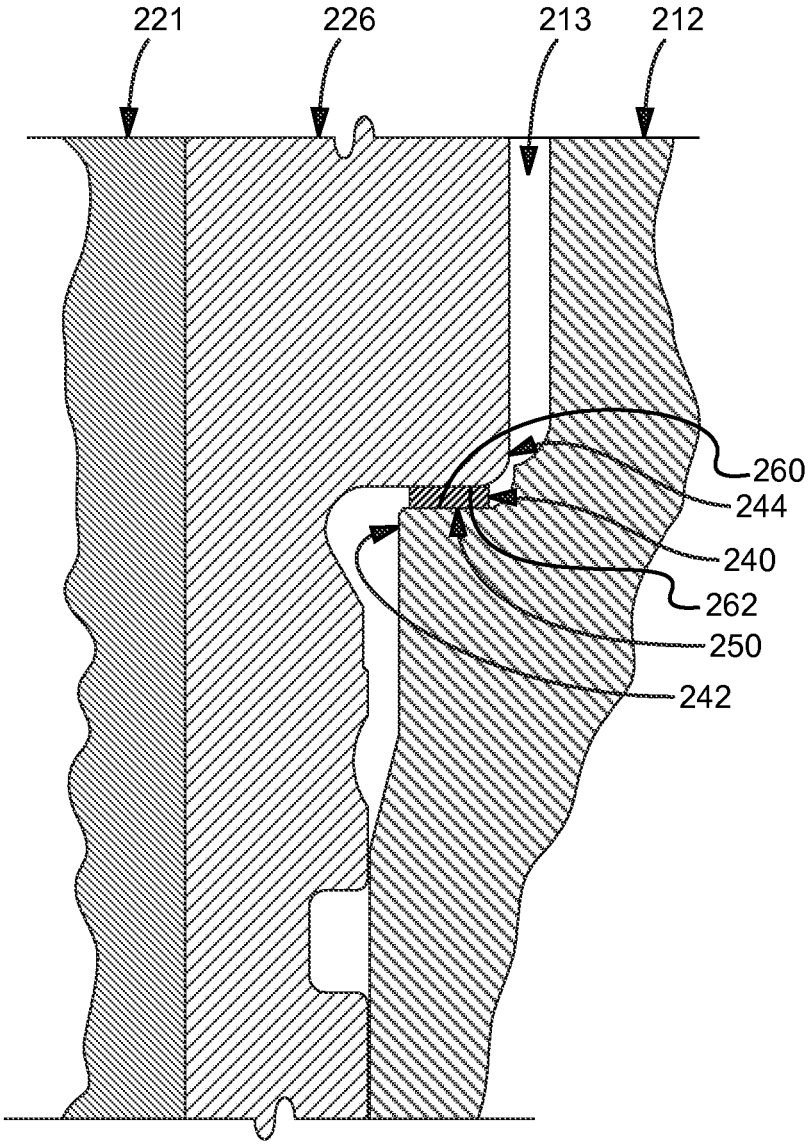
FIG. 5 is a cross-sectional side view of a mid-stop and seat interface with a shim positioned between the mid-stop and seat according to one embodiment.

Referring to FIG. 5, and according to one embodiment, a shim 250 is positioned within the interface 240 between the mid-stop 242 formed in the cylinder 213 of the engine block 212 and the seat 244 formed in the liner 226. The mid-stop 242 may be similar to conventional mid-stop designs without an undercut. Alternatively, the mid-stop 242 may include an undercut as described above. In the illustrated embodiment, the shim 250 is a substantially flat annular ring with a generally rectangular cross-sectional shape. The shim 250 is sized to be supported on the contact surface 260 of the mid-stop 242. An outer diameter of the shim 250 is smaller than the diameter of the cylinder 213 above the mid-stop 242. Further, an inner diameter of the shim 250 is smaller than a diameter of the liner 226 adjacent the interface 240. The shim 250 can have any of various thicknesses as desired.

With the shim 250 positioned within the interface 240, a first side of the shim contacts the contact surface 260 of the mid-stop 242 and an opposing second side of the shim contacts the contact surface 262 of the seat 244. As the contact surface 260 moves radially relative to the contact surface 262 during oscillation of the piston 221, the contact surface 260 slides against the surface of the shim 250 instead of the contact surface 262. Similarly, as the contact surface 262 moves radially relative to the contact surface 260, the contact surface 262 slides against the surface of the shim 250 instead of the contact surface 260. Generally, the shim 250 is made from a material that is different than the materials from which the cylinder 213 and liner 226 are made. In certain implementations, the shim 250 is made from a material that is softer than the cylinder and liner materials. For example, the cylinder 213 and liner 226 may be made from iron, steel, or aluminum, and the shim 250 is made from copper or a copper allow, such as brass. Because the material of the shim 250 is softer than the material of the cylinder 213 and liner 226, relative movement of the cylinder and liner against the shim results in comparatively more wear of the shim than the cylinder and liner. In other words, frictional wear between the shim 250 and the cylinder 213 and liner 226 is predominantly transferred to the shim rather than the cylinder and liner. In this manner, cylinder and liner wear is reduced by virtue of increase wear of the shim 250, which is more easily replaced compared to the cylinder and liner.

Figure 6:
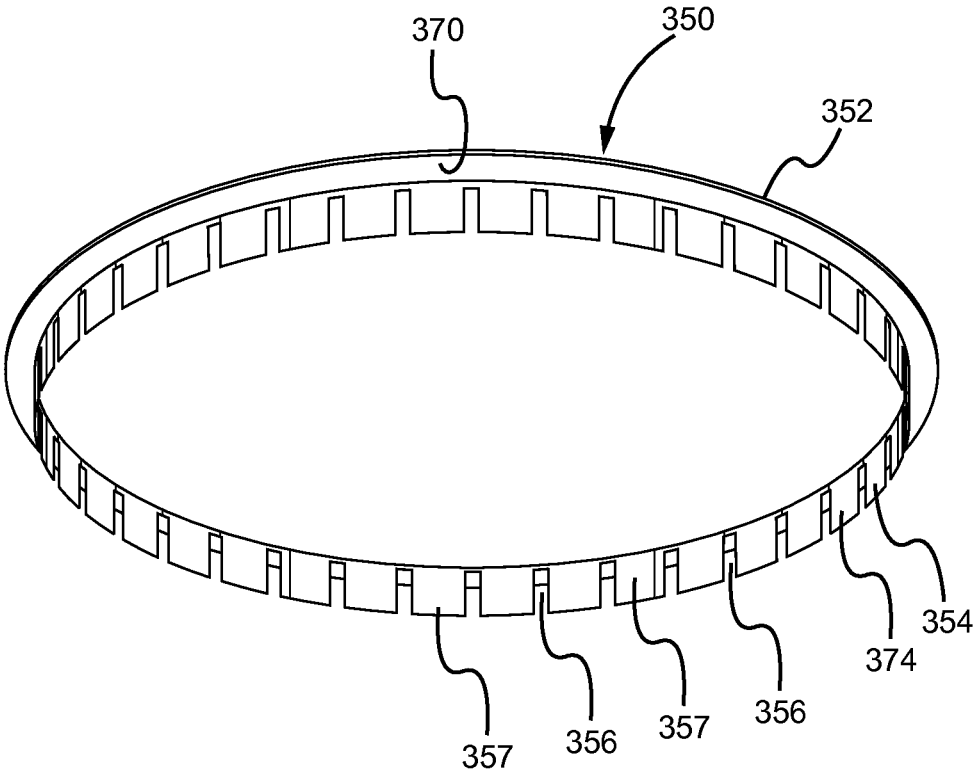
FIG. 6 is a upward perspective view of a shim according to one embodiment.
Figure 8:
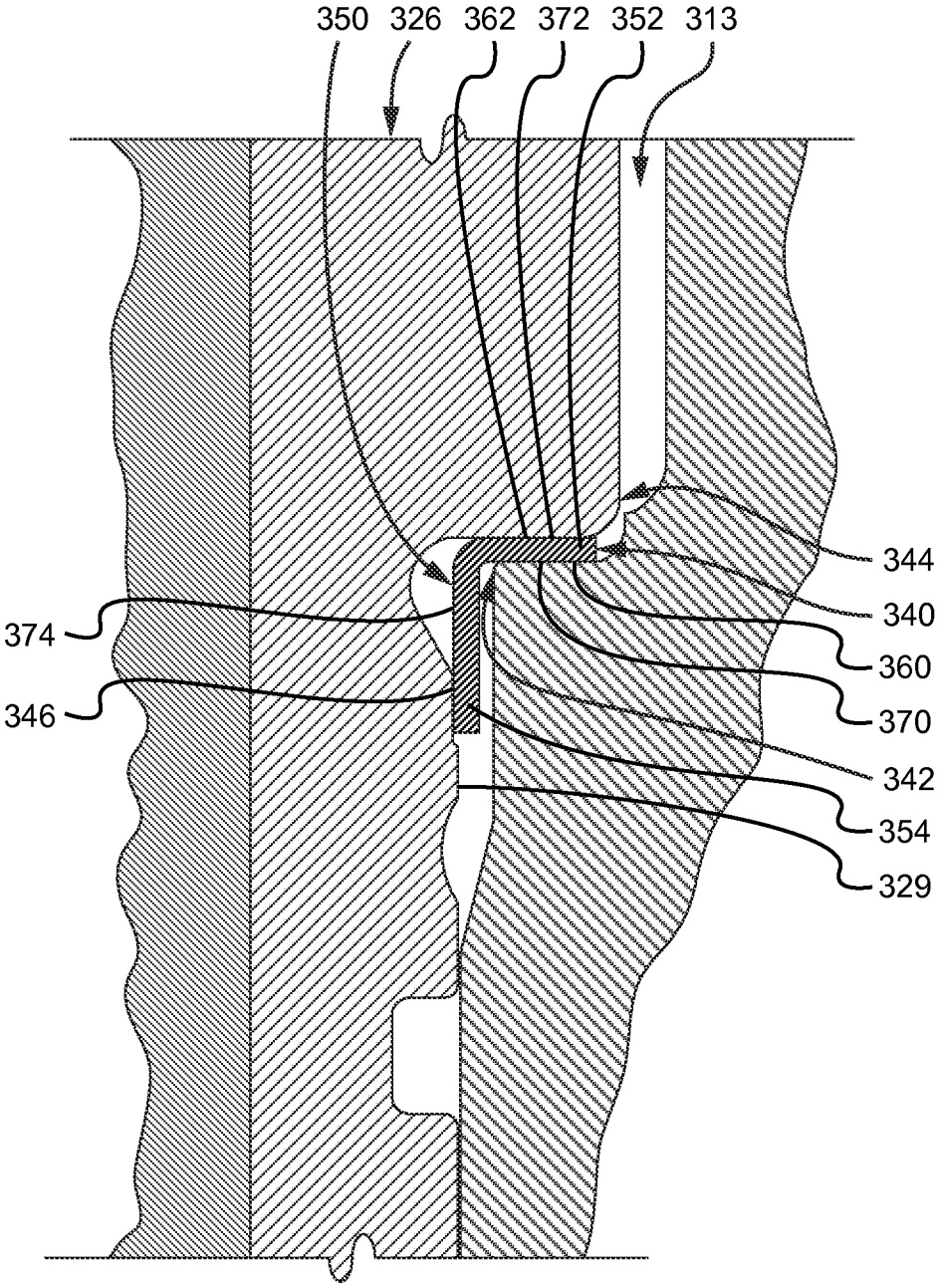
FIG. 8 is a cross-sectional side view of a mid-stop and seat interface with the shim of FIG. 6 positioned between the mid-stop and seat according to one embodiment.

Referring to FIG. 6, according to another embodiment, a self-retaining shim 350 is shown. The shim 350 includes a wear ring 352 and a retaining ring 354 coupled to the wear ring. The wear ring 352 may be similar in size and shape as the shim 250 described above. In other words, the wear ring 352 can be a substantially flat annular ring with a generally rectangular cross-sectional shape. The self-retaining shim 350 may define a central axis about which each corresponding portion of the shim is an equal distance. Defined in this manner, the wear ring 352 includes opposing cylinder and liner contact surfaces 370, 372, respectively, that extend perpendicularly relative to the central axis (also see FIG. 8). The retaining ring 354 includes a liner contact surface 374 that extends parallel relative to the central axis and perpendicularly relative to the cylinder and liner contact surfaces 370, 372. Accordingly, in certain implementations, as shown in FIG. 8, the shim 350 has a generally L-shaped cross-section. The retaining ring 354 includes a plurality of slots 356 formed in the ring that define a plurality of tabs 357 between adjacent slots. In the illustrated embodiment, the slots 356 are spaced apart from each other and extend longitudinally in a direction substantially parallel to the central axis or liner contact surface 374. In some implementations, the slots 356 extend substantially the entire axial length of the retaining ring 354.

Figure 7:
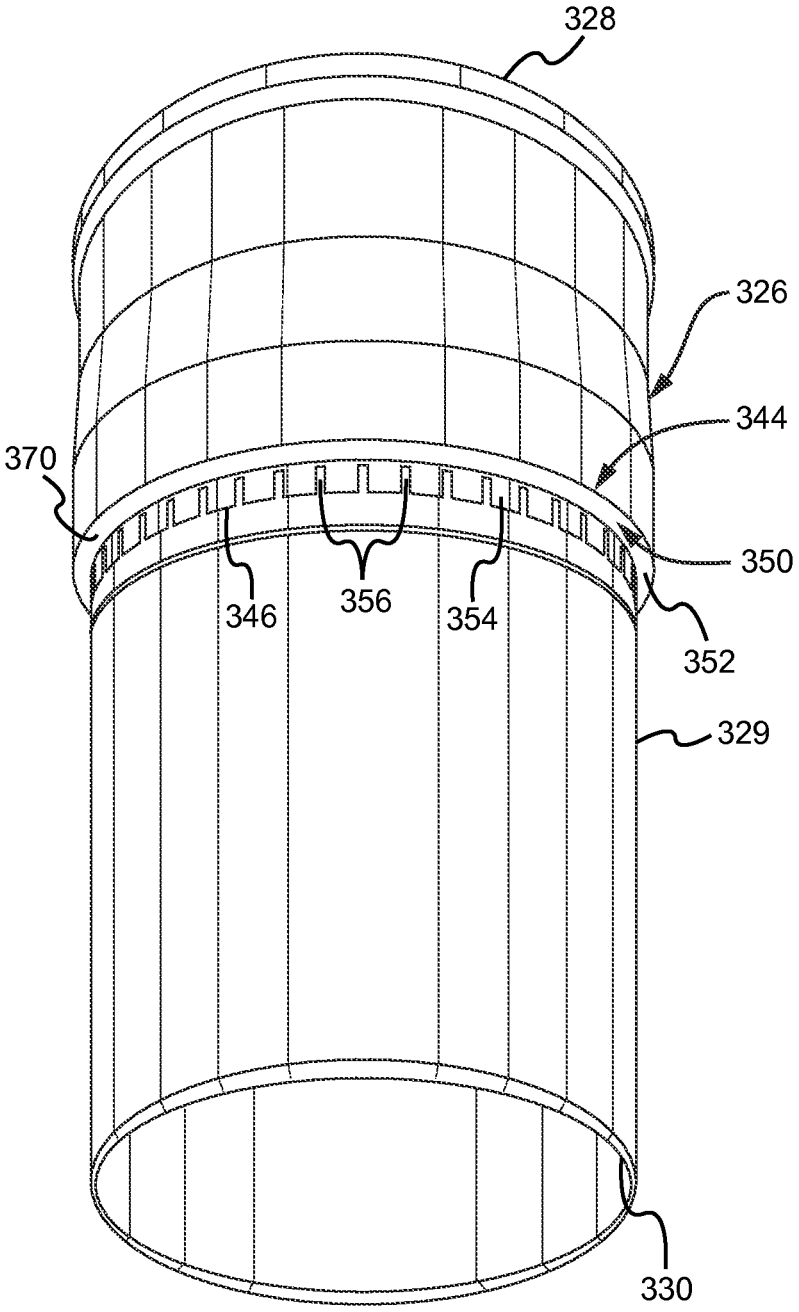
FIG. 7 is an upward perspective view of the shim of FIG. 6 coupled to a cylinder liner according to one embodiment.

As shown in FIG. 7, the self-retaining shim 350 is securely coupled to a cylinder liner 326 proximate a mid-stop seat 344 formed in the liner. The self-retaining shim 350 is centered on the radially outer surface 329 of the cylinder liner 326 such that the shim is coaxial with the liner. To facilitate self-retention of the shim 350, in some embodiments, the cylinder liner 326 includes a retention groove 346 formed in the outer surface 329. The retention groove 346 has an outer diameter that is just less than the outer diameter of the adjacent portion of the liner 326 below the groove. The outer diameter of the outer surface 329 of the liner 326 between the groove 346 and a bottom end 330 of the liner is at least slightly larger than the inner diameter of the shim 350, as defined by the retaining ring 354 of the shim 250, when in an unbiased or unflexed state as depicted in FIG. 6. Moreover, the outer diameter of the retention groove 346 is approximately equal to the inner diameter of the shim 350 when in an unbiased or unflexed state.

The self-retaining shim 350 is securely coupled to the cylinder liner 326 by inserting the bottom end 330 of the liner through the aperture defined by the shim. During insertion, the shim 350 is oriented such that the wear ring 352 is positioned between the retaining ring 354 and the mid-stop seat 344. In other words, during the insertion process, the wear ring 352 is positioned about the cylinder liner 326 before the retaining ring 354 is positioned about the liner. Because in the unflexed state the outer surface 329 between the groove 346 and bottom end 330 has a diameter that is larger than the inner diameter of the shim 350, the retaining ring 354 must deform radially outwardly into a flexed state in order to properly position and align the shim about the liner. The plurality of slots 256 and tabs 257 facilitate radially outward deformation or flexing of the retaining ring 254 by reducing the force necessary to flex the ring to fit around the liner 326. Once on the liner 326, the shim 350 is slid along the liner from the bottom end 330 toward the seat 344 and a top end 328 of the liner until the retaining ring 354 is positioned over the groove 346. The shim 350 can be made from a resiliently flexible material, such as copper or a copper alloy (e.g., brass). Accordingly, as soon as the retaining ring 354 is moved toward the top end 328 to clear a lip of the groove 354, which has a smaller diameter, the resiliently flexible tabs 257 at least partially unflex (e.g., return to the unbiased state) to effectively snap into place (e.g., move radially inwardly) in the groove.

With the retaining ring 354 positioned within the groove 354, the lip of the groove may act as a stop to retain retaining ring, and thus the shim 350, in place about the liner 326. Once positioned about the liner 326, the self-retaining shim 350 is retained in place on the liner during assembly or installation of the liner into the cylinder 313 without manual assistance. In other words, the liner 326 and shim 350 can be handled as a single, monolithic unit for assembly and installation purposes. In this manner, a shim does not need to be installed into the cylinder 313 and aligned with the stop 342 as a separate step before installing the liner 326. Rather, the combined liner 326 and shim 350 may be installed into the cylinder 313 in a single step.

Although in the illustrated embodiment the liner 326 includes a retention groove 346, in other embodiments, the liner does not include a retention groove. In such embodiments, without a retention groove 346, the radially-inwardly directed force applied against the outer surface 329 of the liner 326 due to the resilient flexing of the tabs 357 typically is strong enough to adequately retain the shim 350 in place during assembly of the combine liner and shim in the cylinder 313.

As shown in FIG. 8, when the combined liner 326 and shim 350 are installed in the cylinder 313, the wear ring 352 is positioned within an interface 340 between the mid-stop 342 and the seat 344 in a manner similar to the shim 250 of FIG. 5. A first side of the wear ring 352 of the shim 350 contacts the contact surface 360 of the mid-stop 342 and an opposing second side of the shim contacts the contact surface 362 of the seat 344. With this arrangement, relative movement of the cylinder 313 and liner 326 against the shim 350 results in comparatively more wear of the shim than the cylinder and liner.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An internal combustion engine, comprising:

a cylinder comprising a mid-stop formed in a side wall of the cylinder, The mid-stop comprising a first contact surface positioned between an upper section of the side wall and a lower section of the side wall, the upper section of the side wall having a greater diameter than the lower section of the side wall, the cylinder further comprising an undercut formed in the mid-stop and positioned between the first contact surface and the side wall, the undercut descending a depth below the first contact surface, the undercut extending from the mid-stop to the side wall, the undercut defining an open space in the mid-stop;

a liner positioned within the cylinder, the liner comprising a seat having a second contact surface, wherein the second contact surface is supported on the first contact surface; and a retaining shim coupled to the liner, the retaining shim including a wear ring and a retaining ring coupled the wear ring, the wear ring configured to be positioned between the first contact surface of the mid-stop and the second contact surface of the seat of the liner, the retaining ring configured to be positioned between the liner and the lower section of the side wall.

2. The internal combustion engine of claim 1, wherein the cylinder defines a central axis, the first contact surface being substantially perpendicular to the central axis.

3. The internal combustion engine of claim 2, wherein the retaining ring is L-shaped.

4. The internal combustion engine of claim 1, wherein the mid-stop comprises a mid-stop region defining the first contact surface, and wherein the undercut defines a space between the mid-stop region and the side wall.

5. The internal combustion engine of claim 4, wherein the mid-stop region is deformable in a radially outward direction toward the side wall when subjected to operational loads.

6. The internal combustion engine of claim 1, wherein the retaining ring includes a plurality of slots.

7. A method for reducing wear in an internal combustion engine comprising a cylinder and a cylinder liner supported within the cylinder, the method comprising:

providing a mid-stop within the cylinder, the mid-stop comprising a mid-stop region positioned between an upper section of the side wall and a lower section of the side wall, the upper section of the side wall having a greater diameter than the lower section of the side wall;

forming an undercut in the mid-stop, the undercut positioned between the first contact surface and the side wall, the undercut formed such that the undercut descends a depth below an upper surface of the mid-stop, the undercut extending from the mid-stop to the side wall, the undercut defining an open space in the mid-stop;

providing a seat on the cylinder liner;

coupling a retaining shim to the cylinder liner, the retaining shim including a wear ring and a retaining ring coupled the wear ring; and positioning the cylinder liner in the cylinder such that the wear ring is positioned between the mid-stop region and the seat of the cylinder liner, the retaining ring positioned between the cylinder liner and the lower section of the side wall.

8. The method of claim 7, wherein the retaining ring is L-shaped.

9. The method of claim 7, wherein the retaining ring includes a plurality of slots.

* * * * *